US006241577B1

(12) United States Patent
Shibata

(10) Patent No.: US 6,241,577 B1
(45) Date of Patent: Jun. 5, 2001

(54) LENS GRINDING APPARATUS AND LENS GRINDING METHOD AND COMPONENT THEREFOR

(75) Inventor: Ryoji Shibata, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/038,091

(22) Filed: Mar. 11, 1998

(30) Foreign Application Priority Data

Mar. 11, 1997 (JP) ..... 9-076621

(51) Int. Cl.[7] ..... B24B 9/14
(52) U.S. Cl. ..... 451/5
(58) Field of Search ..... 451/5, 43, 384; 269/140, 141, 43, 48.1; 29/252, 246; 82/162, 117, 165, 9

(56) References Cited

U.S. PATENT DOCUMENTS

| | | | | |
|---|---|---|---|---|
| 2,545,448 | * | 3/1951 | Clement | 51/131 |
| 3,745,720 | * | 7/1973 | Savage | 24/9 |
| 4,561,213 | * | 12/1985 | Tusinski et al. | 24/5 |
| 4,856,234 | * | 8/1989 | Goins | 51/284 |
| 5,228,242 | | 7/1993 | Matsuyama | 51/165.74 |
| 5,333,412 | | 8/1994 | Matsuyama | 51/165.71 |
| 5,384,987 | * | 1/1995 | Wiand | 451/41 |
| 5,716,256 | | 2/1998 | Mizuno et al. | 451/5 |

FOREIGN PATENT DOCUMENTS

| | | | |
|---|---|---|---|
| 3-20603 | 1/1991 | (JP) | G01B/5/06 |
| 9-253999 | 9/1997 | (JP) | B24B/9/14 |

* cited by examiner

*Primary Examiner*—Rodney A. Butler
(74) *Attorney, Agent, or Firm*—Sughrue, Mion, Zinn, Macpeak & Seas, PLLC

(57) ABSTRACT

A lens grinding apparatus with which an ordinary lens having a large diameter to work on and a lens for "granny's glasses" can be processed efficiently without employing dedicated cup receptacles and lens retainers and yet with a reduced potential for misalignment in the axis of the lens that occurs during processing. The apparatus has a first lens rotating shaft having mounted thereon a cup receptacle member that is so shaped as to enable the processing of a lens for "granny's glasses" and to which a lens fixing cup is to be fitted, a second lens rotating shaft having mounted thereon a lens retaining member that is so shaped as to enable the processing of the lens for "granny's glasses". The angle of rotation of the second rotating shaft is adjusted such that when the lens to be processed is an ordinary lens having a large diameter to work on and an astigmatic component, a direction of the second lens rotating shaft which is perpendicular to a direction of the long side of the lens retaining member generally coincides with the astigmatic axis of the lens to be processed.

18 Claims, 9 Drawing Sheets

LENS GRINDING APPARATUS AND LENS GRINDING METHOD AND COMPONENT THEREFOR

BACKGROUND OF THE INVENTION

This invention relates to a lens grinding apparatus and lens grinding method for grinding a lens to conform it to the shape of an eyeglass frame, as well as components in connection with the apparatus and the method.

In a lens grinding apparatus for grinding an eyeglass lens to conform it to the shape of an eyeglass frame, a lens is worked on as it is chucked between two lens rotating shafts. To chuck the lens, a fixing (securing) cup is first set on the front surface of the lens in the desired position determined with a centering device. The base of the fixing (securing) cup is fitted in a cup receptacle mounted on one of the two lens rotating shafts and the lens is chucked with its rear surface being held in position with a lens retainer mounted on the other lens rotating shaft.

The lens being ground is under the stress of the reaction and rotating forces provided by the lens grinding wheel. If the chucking force is smaller than the stress, the axial misalignment of the lens may occur. To avoid this problem and secure the necessary chucking force, a lens having a sufficient diameter to work on is ground using a circular fixing (securing) cup with a large diameter across the mounting surface and a circular lens retainer also having a large diameter.

However, if a lens for "granny's glasses" which has a small distance between the upper and lower edges is processed using a fixing (securing) cup, a cup receptacle and a lens retainer which are of the same sizes as in the case of processing lenses having a sufficient diameter to work on, these components will interfere with the lens grinding wheel. To avoid this problem, they must be replaced by components of smaller diameters which are specially intended for use in the processing of lenses for "granny's glasses".

However, replacing the cup receptacle and the lens retainer according to the lens diameter to be worked on is not only more time-consuming than one will usually expect but also cumbersome. Frequent replacing operations will reduce the efficiency of the lens processing operation at a processing center where a large number of lenses are collectively worked at the request of optician's shops.

SUMMARY OF THE INVENTION

The present invention has been accomplished under these circumstances and has as an object providing a lens grinding apparatus which is capable of processing different types of lens efficiently without the need for replacing the cup receptacle and the lens retainer and yet with a reduced possibility of misalignment in the axis of the lens during processing.

The present invention provides the followings:

(1) A lens grinding apparatus for grinding an eyeglass lens to conform it to the shape of an eyeglass frame, said lens grinding apparatus comprising:

a first lens rotating shaft having mounted thereon a cup receptacle member that is so shaped as to enable the processing of a lens for "granny's glasses" and to which a lens fixing cup is to be fitted;

a second lens rotating shaft having mounted thereon a lens retaining member that is so shaped as to enable the processing of the lens for "granny's glasses";

rotating means for rotating said first and second rotating shafts independently of each other; and adjusting means for adjusting the angle of rotation of said second rotating shaft such that when the lens to be processed is an ordinary lens having a large diameter to work on and an astigmatic component, a direction of said second lens rotating shaft which is perpendicular to a direction of the long side of said lens retaining member generally coincides with the astigmatic axis of said lens to be processed.

(2) The lens grinding apparatus according to (1), wherein said cup receptacle member has a means for fitting said lens fixing cup such that the astigmatic axis of said lens to be processed is positioned to satisfy a specified relationship.

(3) The lens grinding apparatus according to (1), wherein said lens retainer member is prolate in shape having two parallel edges and two arcs each having a center on the rotation axis.

(4) The lens grinding apparatus according to (1), wherein said adjusting means includes:

input means for entering the direction of the astigmatic axis of the lens to be processed; and control means for controlling said rotating means such that the angle of rotation of said second lens rotating shaft is rotated relative to said first lens rotating shaft based on the entered direction of astigmatic axis.

(5) The lens grinding apparatus according to (1), further comprising:

processing mode selecting means for selecting between a mode for processing a lens for "granny's glasses" and a mode for processing an ordinary lens having a large diameter to work on, and control means which, when the mode for processing the lens for "granny's glasses" is selected, controls the rotation of said rotating means such that the direction of the long side of said lens retaining member generally coincides with that of the cup for fixing the lens for "granny's glasses".

(6) A lens grinding apparatus for grinding an eyeglass lens to conform it to the shape of an eyeglass frame, said apparatus comprising:

a first lens rotating shaft for mounting a cup receptacle member to which a lens fixing cup is to be fitted;

a second lens rotating shaft for mounting a lens retaining member; and rotating means for rotating said first and second lens rotating shafts independently of each other.

(7) A lens grinding method for grinding an eyeglass lens to conform it to the shape of an eyeglass frame, said method comprising the steps of:

mounting a lens fixing cup fixed to the lens to be processed on a cup receptacle member, the cup receptacle member being so shaped as to enable the processing of a lens for "granny's glasses" and mounted on a first lens rotating shaft for holding the lens to be processed; and adjusting the angle of rotation of a second lens rotating shaft, which is for holding the lens in combination with the first lens rotating shaft, such that a direction perpendicular to a direction of the long side of a lens retaining member mounted on said second lens rotating shaft generally coincides with the direction of the astigmatic axis of said lens to be processed if the lens to be processed is an ordinary lens having a large diameter and has an astigmatic component.

(8) A lens fixing cup for use in a lens grinding apparatus, which is formed of a rigid material.

(9) A cup receptacle member for use in a lens grinding apparatus, which is so shaped as to enable the processing of a lens for "granny's glasses" and has a means for fitting a lens fixing cup that is fixed to satisfy a specified relationship with a lens to be processed such that the astigmatic axis of said lens to be processed is positioned to satisfy a specified relationship.

(10) A lens chucking part for use with an eyeglass lens grinding apparatus having first and second shafts rotatable about an axis, and relatively movable toward and away from each other for chucking a lens to be processed, said lens chucking part comprising:

a lens retainer mounted on an end of said first shaft, said lens retainer having an oblong shape in section as viewed in a plane perpendicular to said axis;

a cup holder mounted on an end of said second shaft facing said end of said first shaft, said cup holder having an oblong shape in section as viewed in a plane perpendicular to said axis;

a fixing cup adapted to be fixedly mounted on the lens to be processed and received by said cup holder.

(11) A lens chuck part according to (10), wherein said fixing cup has a cylindrical base received by said cup holder and a substantially conical cup portion to be mounted on the lens, and wherein an outermost perimeter of said cup portion about said axis is oblong.

(12) A lens chuck part according to (10), wherein said oblong shape of said lens retainer is substantially coincident with said oblong shape of said cup holder.

(13) A lens chuck part according to (11), wherein said oblong outermost perimeter of said fixing cup is substantially coincident with each of said oblong shapes of said lens retainer and cup holder.

(14) A lens chuck part according to (10), wherein each of said oblong shapes of said lens retainer and cup holder has linear portions parallel to each other, and arcuate portions each connecting said linear portions.

(15) A lens chuck part according to (11), wherein each of said oblong shapes of said lens retainer, cup holder and fixing cup has linear portions parallel to each other, and arcuate portions each connecting said linear portions.

(16) A lens chuck part according to (10), wherein each of said oblong shapes of said lens retainer and cup holder has a minor diameter no more than 19 mm.

(17) A lens chuck part according to (11), wherein each of said oblong shapes of said lens retainer, cup holder and fixing cup has a minor diameter no more than 19 mm.

(18) A lens chuck part according to (10), further comprising:

means for relatively rotating said first shaft with respect to said second shaft prior to chucking of the lens to establish an angular position wherein a minor diameter of said oblong shape of said lens retainer is substantially coincident with a direction of an astigmatic axis of the lens, and relatively moving said first shaft with respect to said second shaft for chucking of the lens while maintaining said angular position.

(19) A lens chuck part according to (10), wherein said fixing cup is made of rigid material.

(20) A lens chuck part according to (19), wherein said rigid material includes a mixture of polycarbonate and glass fibers.

DESCRIPTION OF THE PREFERRED EMBODIMENT

A lens grinding apparatus according to an embodiment of the present invention will be hereinafter described with reference to the accompanying drawings.

Configuration of Whole Apparatus

Figure 1:
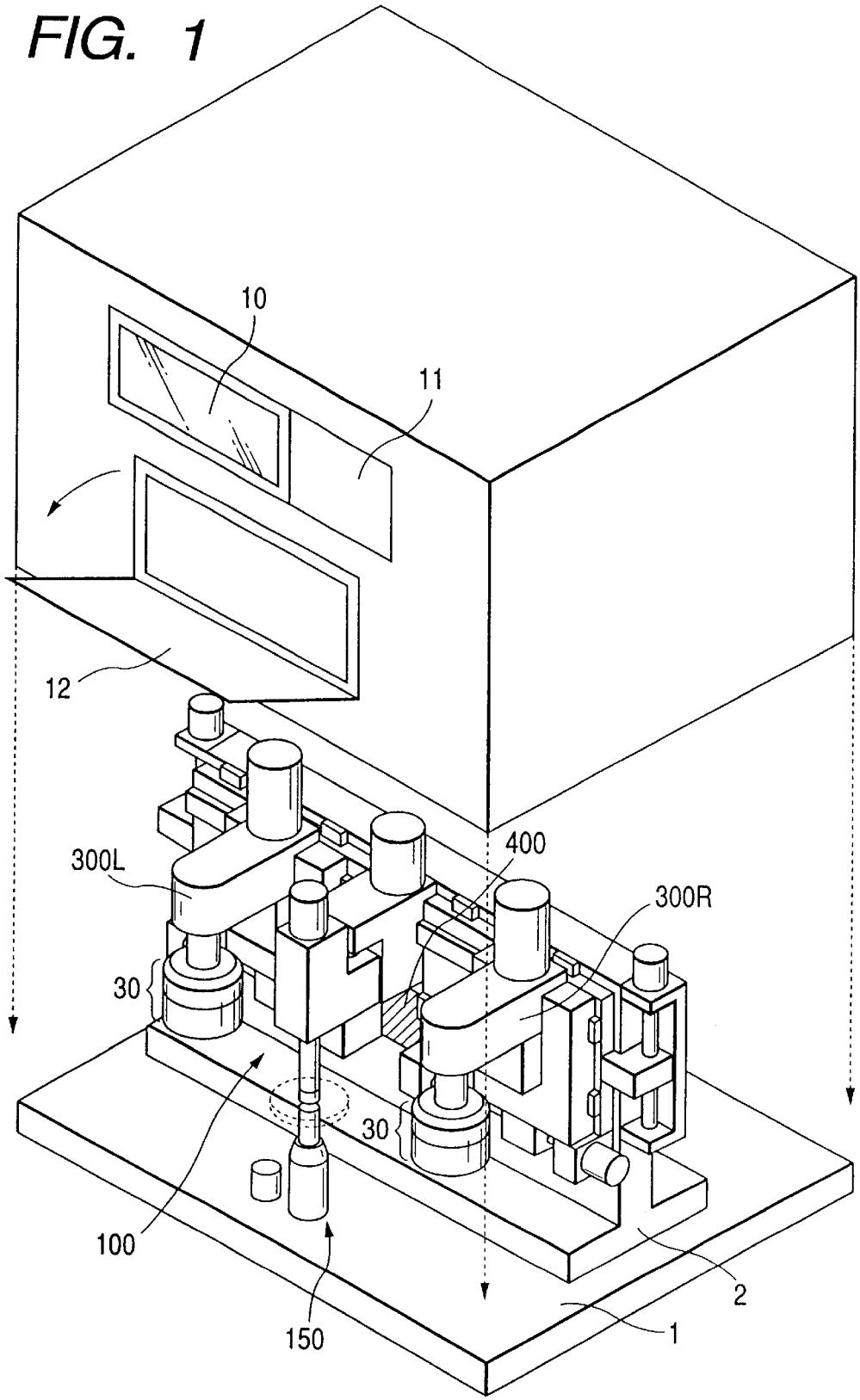
FIG. 1 shows the general layout of the lens grinding apparatus of the invention.

In FIG. 1, reference numeral 1 denotes a main base, and 2 denotes a sub-base that is fixed to the main base 1. A lens chuck upper part 100 and a lens chuck lower part 150 hold a lens to be processed by means of their respective chuck shafts during processing it. A lens configuration measuring section 400 (see, for instance, Japanese Patent Kokai Publication No. 3-20603) is accommodated below the lens chuck upper part 100 in the depth of the sub-base 2. Reference symbols 300R and 300L respectively represent right and left lens grinding parts each having grinding wheels 30 on its rotary shaft for lens grinding, such as a rough grinding wheel for plastics, a finishing grinding wheel, and chamfering grinding wheels for rear and front surfaces. Each of the lens grinding parts 300R and 300L is held by a moving mechanism (described later) so as to be movable in the vertical and horizontal directions with respect the sub-base 2.

A display unit 10 for displaying processing data and other information and an input unit 11 for allowing a user to input data or an instruction to the lens grinding apparatus are provided in the front surface of a body of the apparatus. Reference numeral 12 denotes a closable door.

Structures of Main Parts

<Lens Chuck Part>

(1) Lens Chuck Upper Part

Figure 2:
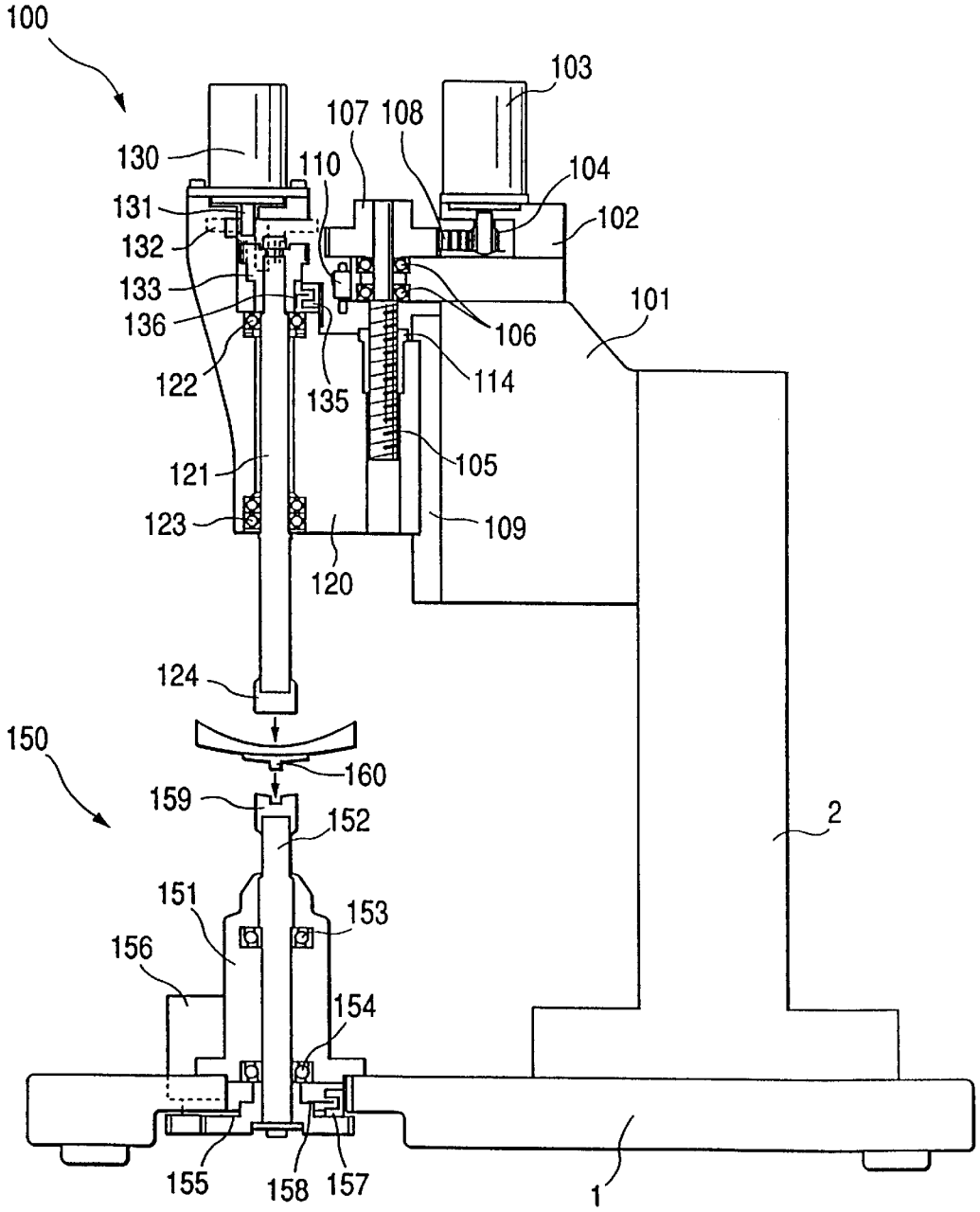
FIG. 2 illustrates the upper and lower parts of the lens chuck mechanism.

In FIG. 2, a fixing block 101 is fixed to the sub-base 2, and a DC motor 103 for vertically moving a chuck shaft 121 is mounted on top of the fixing block 101 by means of a mounting plate 102. The rotational force of the DC motor 103 is transmitted through a pulley 104, a timing belt 108 and a pulley 107 to a feed screw 105. As the feed screw 105 is rotated, a nut 114 meshing with the feed screw 105 drives a chuck shaft holder 120 vertically while being guided by a guide rail 109 fixed to the fixing block 101. A micro switch 110 is mounted on the fixing block 101, which detects a reference position when the chuck shaft holder 120 is elevated.

A pulse motor 130 for rotating the chuck shaft 121 is fixed to the top portion of the chuck shaft holder 120. The rotational force of the pulse motor 130 is transmitted, via a gear 131 that is attached to its rotary shaft and a relay gear 132, to a gear 133 that is attached to the chuck shaft 121, to rotate the chuck shaft 121. Reference numeral 124 denotes a lens retainer (described later in detail) attached to the chuck shaft 121. Reference numeral 135 denotes a photosensor and 136 denotes a light-shielding plate that is mounted on the chuck shaft 121. The photosensor 135 detects a rotation reference position of the chuck shaft 121.

(2) Lens Chuck Lower Part

In FIG. 2, a lower chuck shaft 152 is rotatably held by a chuck shaft holder 151 through bearings 153 and 154, and the chuck shaft holder 151 is fixed to the main base 1. A gear 155 is fixed to the bottom end of the chuck shaft 152. The rotational force of a pulse motor 156 is transmitted to the chuck shaft 152 by a gear arrangement (not shown) that is similar to the counterpart in the upper chuck part, to rotate the chuck shaft 152. Reference numeral 159 denotes a cup receptacle attached to the chuck shaft 152, which receives a fixing (securing) cup fixedly attached to a lens to be processed, thereby holding the lens (described later in detail with respect to its arrangement). Reference numeral 157 denotes a photosensor and 158 denotes a light-shielding plate that is mounted on the gear 155. The photosensor 157 detects a rotation reference position of the chuck shaft 152.

(C) Fixing (Securing) Cup, Lens Retainer and Cup receptacle

Figure 3A:
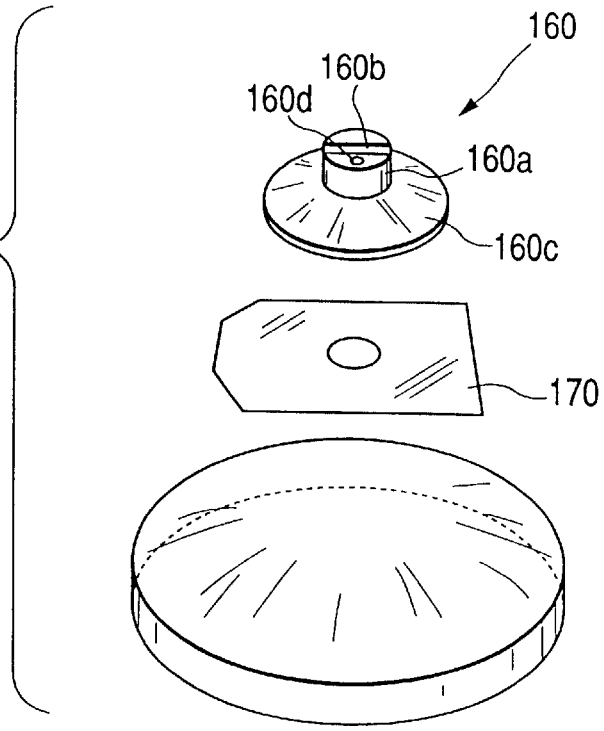
FIGS. 3A and 3B respectively illustrate two types of a fixing (securing) cup to be employed in the apparatus according to the preferred embodiment of the invention.

The fixing (securing) cup to be used on the apparatus in the embodiment under consideration is now described with reference to FIGS. 3A and 3B. The fixing (securing) cup indicated by 160 in FIG. 3A is intended for use when processing an ordinary lens of a large diameter to be worked on and it comprises a cylindrical base 160*a* to be fitted into the cup receptacle 159, a key groove 160*b* formed in the base 160*a*, and a cup portion 160*c* for fixing the lens in position. The cup portion 160*c* is such that a surface perpendicular to the associated lens rotating shaft is of a circular form (about 22 to 24 mm in diameter) having radii of the same value and the side facing up as seen in FIG. 3A forms a conical profile. The side facing down of the cup portion 160*c* provides a slightly concave slope in profile and can be adhered to the front surface of the lens by means of a double-face pad 170. The base 160*a* also has a position mark 160*d* formed thereon for determining the upper or lower edge of the lens being mounted (and, hence, being worn by the user). The fixing (securing) cup 160 having this structural design is fabricated by a well-known molding technique using a mixture of polycarbonate and glass fibers and has greater rigidity than rubber suction cups.

Figure 3B:
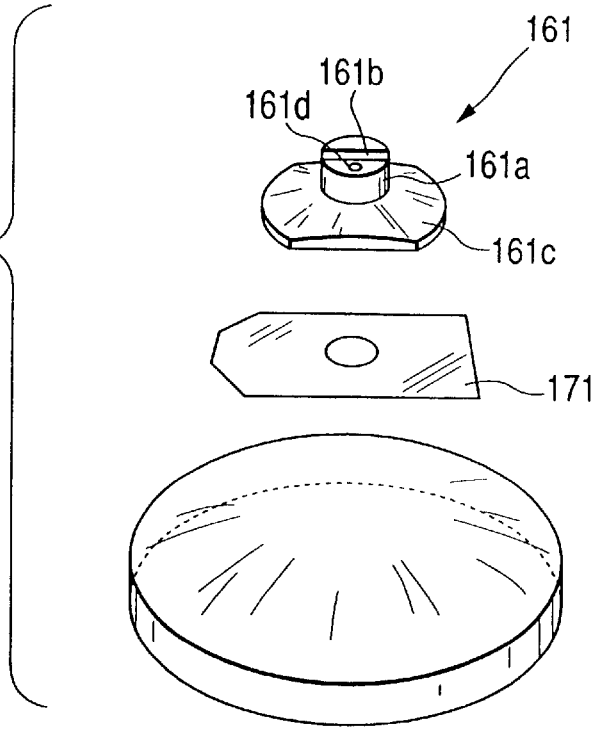

The fixing (securing) cup indicated by 161 in FIG. 3B is intended for use when processing a lens for "granny's glasses" and it has a base 161*a*, a key groove 161*b* and a mark 161*d* which are of the same shapes as those employed with the fixing (securing) cup 160 for use in processing ordinary lenses. The cup portion 161*c* of the fixing (securing) cup 161 is such that a surface perpendicular to the associated lens rotating shaft is of a prolate shape having a slightly smaller diameter than the cup portion 160*c* (but having radii of the same value), provided that the upper and lower arcs of the circle were partly cut off to provide linear portions. The resultant width between the linear portions is set to be about 18 mm so that a lens for "granny's glasses" small in width in vertical direction can be effectively processed without interference between the fixing (securing) cup 161 and the lens grinding wheel. The cup portion 161*c* is adhered to the front surface of the lens by means of a double-face pad 171 having a smaller distance between the upper and lower edges than the pad 170.

Figure 4:
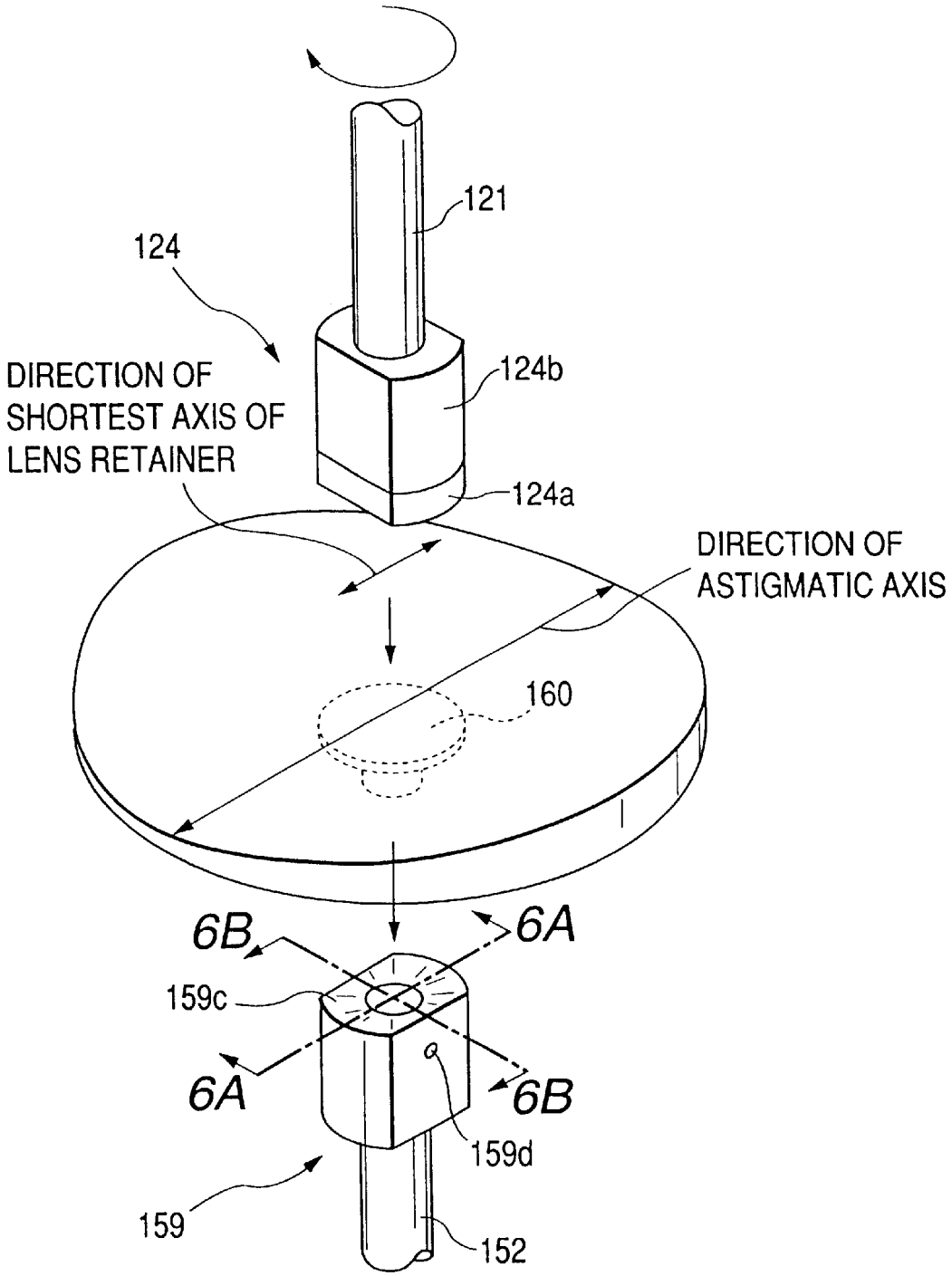
FIG. 4 illustrates the structures of the lens retainer and the cup receptacle in the apparatus according to the preferred embodiment of the invention, as well as their orientation.
Figure 5:
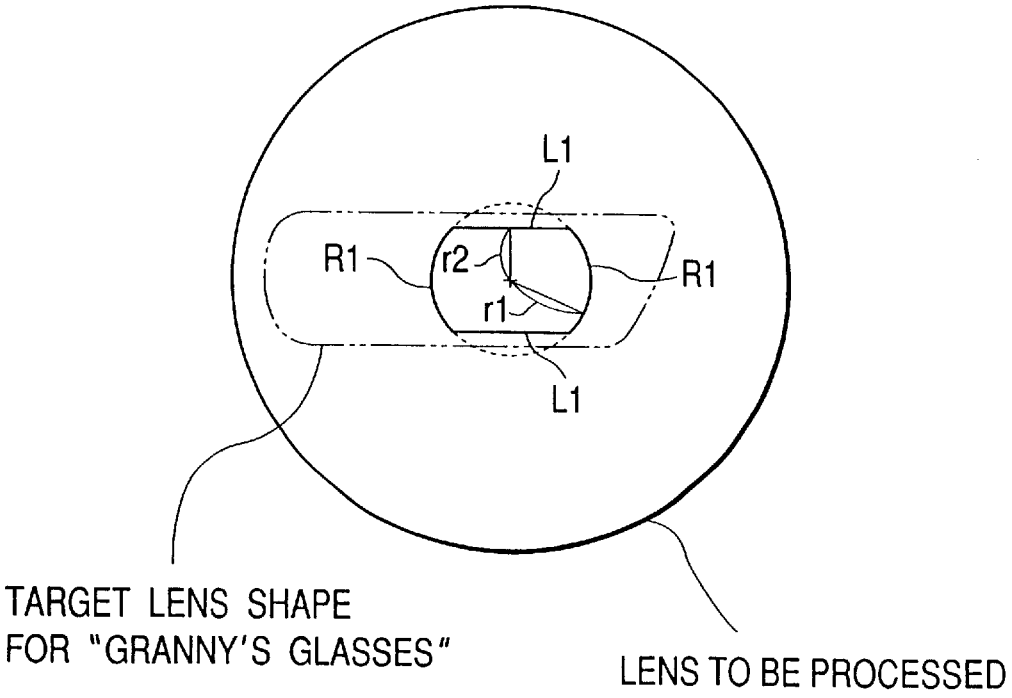
FIG. 5 illustrates the shape of the lens retainer used in the apparatus according to the preferred embodiment of the invention.

The structural designs of the lens retainer 124 and the cup receptacle 159 will now be described with reference to FIGS. 4, 5, 6A and 6B. The lens retainer 124 comprises a rubber contact member 124*a* which is to be brought into contact with the rear surface of the lens to be chucked and a support 124*b* for the contact member 124*a*. A cross section of the lens retainer 124 (which is perpendicular to the associated rotating shaft) has a prolate shape, or a circle with the upper and lower arcs cut off, as shown in FIGS. 4 and 5. The remaining two arcs R1 having the same radius r1 are such that an imaginary circle on which these two arcs R1 is laid has a diameter either generally the same as or slightly smaller than the outside diameter of the fixing (securing) cup 160 for use in processing ordinary lenses. The linear portions L1 of the lens retainer 124 on the upper and lower edges as seen in FIG. 5 are spaced apart by a distance that will not interfere with the grinding wheel while processing a lens for "granny's glasses". As guide figures, the radius r1 may be set at 11 mm and r2 which represents the shortest distance from the center of the rotating shaft to either linear portion L1 is set at 9 mm. If the distance between the upper and lower edges of the lens retainer 124 is set at no more than 19 mm, almost all sizes of lenses for "granny's glasses" can be processed effectively.

Figure 6A:
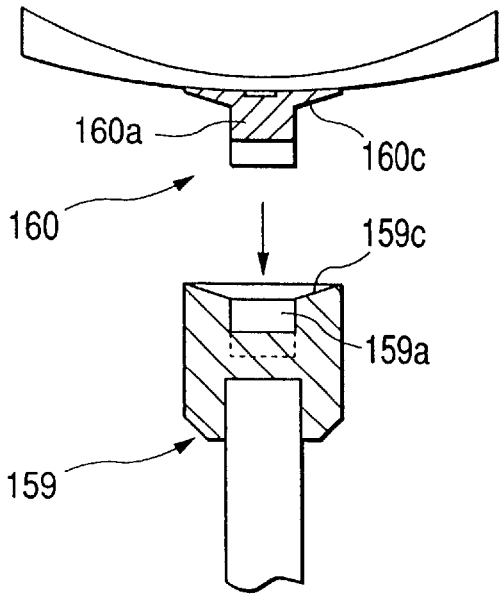
FIGS. 6A and 6B each illustrate the shape of the cup receptacle in section used in the apparatus according to the preferred embodiment of the invention.
Figure 6B:
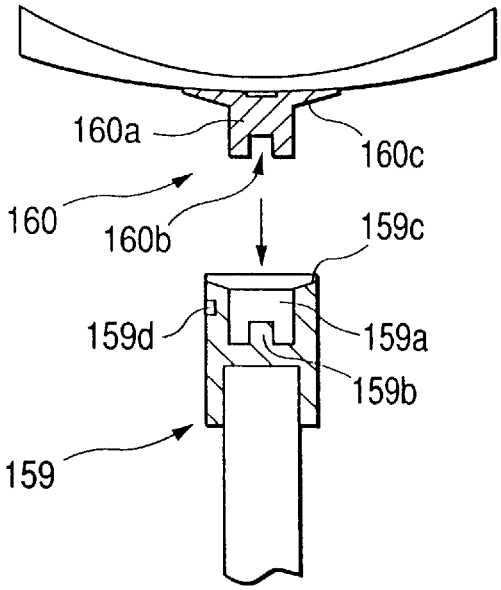

The cup receptacle 159 has a prolate cross section which is similar in shape to the lens retainer 124 and which has the same (or slightly smaller) outside dimensions than the latter. As shown in FIGS. 6A and 6B, the cup receptacle 159 has a hole 159*a* into which the base 160*a* of the fixing (securing) cup 160 is to be fitted, and a key 159*b* which is to engage the key groove 160*b* in the fixing (securing) cup 160 is formed in the bottom of the hole 159*a*. The top end 159*c* of the cup receptacle 159 has a concave conical slope which is to retain the cup portion 160*c* of the fixing (securing) cup 160 by contacting its conical slope. A lateral side of the cup receptacle 159 has a position mark 159*d* formed to assist in the mounting of the fixing (securing) cup 160 after it was attached to the lens.

Having the shape described above, the cup receptacle 159 is capable of holding not only the cup 160 for fixing ordinary lenses but also the cup 161 for fixing the lens for "granny's glasses" in such a manner that the linear portions spaced apart by the shortest distance correspond to the respective linear portions of the latter lens, thereby enabling its processing without interfering with the grinding wheel.

The cup receptacle 159 has a smaller diameter across the linear portions than across the arcuate portions but in the case of processing an ordinary lens having a large diameter to work on, the use of the fixing (securing) cup 160 made of a rigid material ensures that the necessary fixing force is maintained across the entire part of the outside diameter of the cup portion 160*c* and there is no possibility for the retaining force to become insufficient on the cup receptacle 159. In view of this, the retaining force of the cup receptacle 159 will not decrease greatly even if it is made in a cylindrical shape having the same diameter in every part to allow for the processing of a lens for "granny's glasses".

<Moving Mechanism for Lens Grinding Part>

Figure 7:
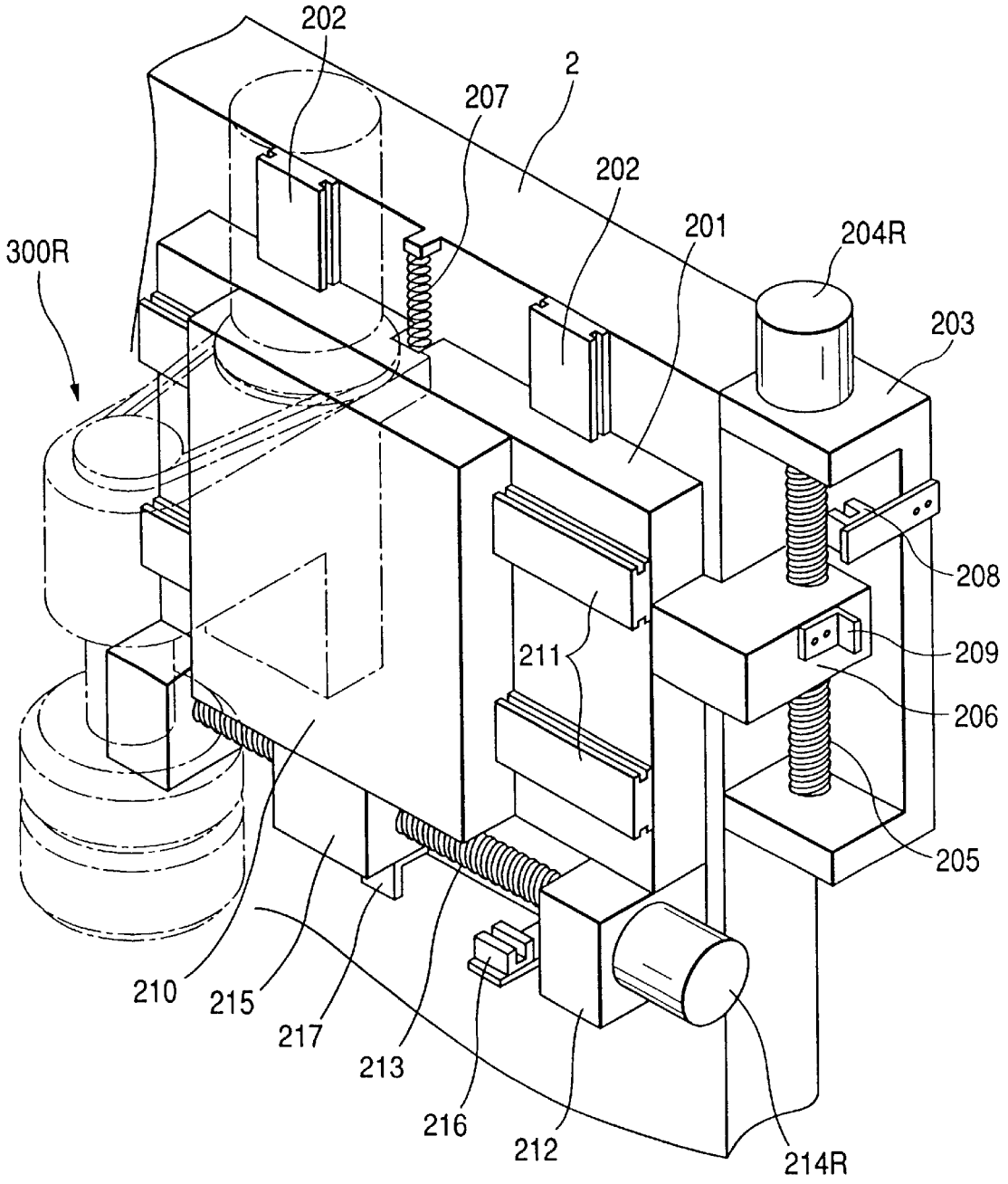
FIG. 7 illustrates the mechanism for moving the lens grinding section 300R.

FIG. 7 illustrates a mechanism for moving the right lens grinding part 300R. (Since a moving mechanism for the left lens grinding part 300L is symmetrical with that for the right lens grinding part 300R, it will not be described.) When a pulse motor 204R rotates a ball screw 205 to move a nut block 206 meshing with the ball screw 205, a vertical slide base 201 is moved accordingly in the vertical direction while being guided by a pair of guide rails 202 fixed to the front surface of a sub-base 2. When a pulse motor 214R rotates a ball screw 213, a horizontal slide base 210 to which the right lens grinding part 300R is fixed is moved accordingly in the horizontal direction along a pair of guide rails 211 fixed to the front surface of the vertical slide base 201.

<Lens Grinding Part>

Figure 8:
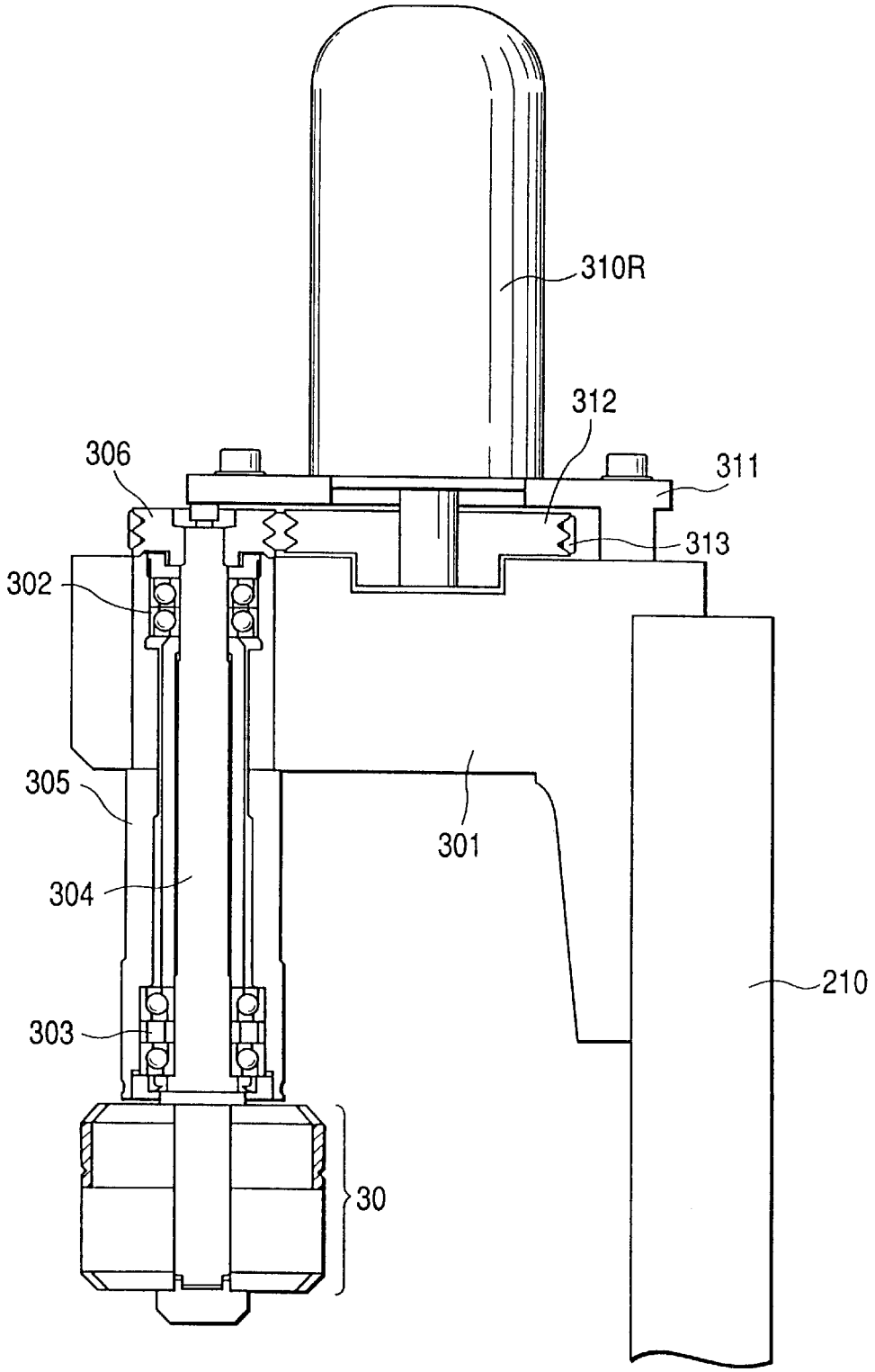
FIG. 8 is a side sectional view showing the structure of the lens grinding section 300R.

FIG. 8 is a side sectional view showing the structure of the right lens grinding part 300R. A shaft support base 301 is fixed to the horizontal slide base 210. A housing 305 is fixed to the front portion of the shaft support base 301, and rotatably holds therein a vertically extending rotary shaft 304 through bearings 302 and 303. A group of grinding wheels 30 are mounted on the lower portion of the rotary shaft 304. A servo motor 310R for rotating the grinding wheels is fixed to the top surface of the shaft support base 301 through a mounting plate 311. The rotational force of the servo motor 310R is transmitted via a pulley 312, a belt 313 and a pulley 306 to the rotary shaft 304, thereby rotating the group of the grinding wheels 30.

Since the left lens grinding part 300L is symmetrical with the right lens grinding part 300R, its structure will not be described.

With the driving control on the pulse motors of the above-described moving mechanisms, each of the right and left lens grinding parts 300R and 300L is moved vertically and horizontally with respect to the lens being held by the upper and lower chuck shafts 121 and 152. These movements of the right and left grinding parts 300R and 300L bring selected ones of the grinding wheels into contact with the lens, so that the selected grinding wheels grind the lens. It is noted that in this embodiment the rotation axis of the chuck shafts 121 and 152 of the lens chuck upper part 100 and the lens chuck lower part 150 is so arranged as to be located on the straight line connecting the centers of the two respective shafts 304 of the lens grinding parts 300R and 300L.

<Control System>

Figure 9:
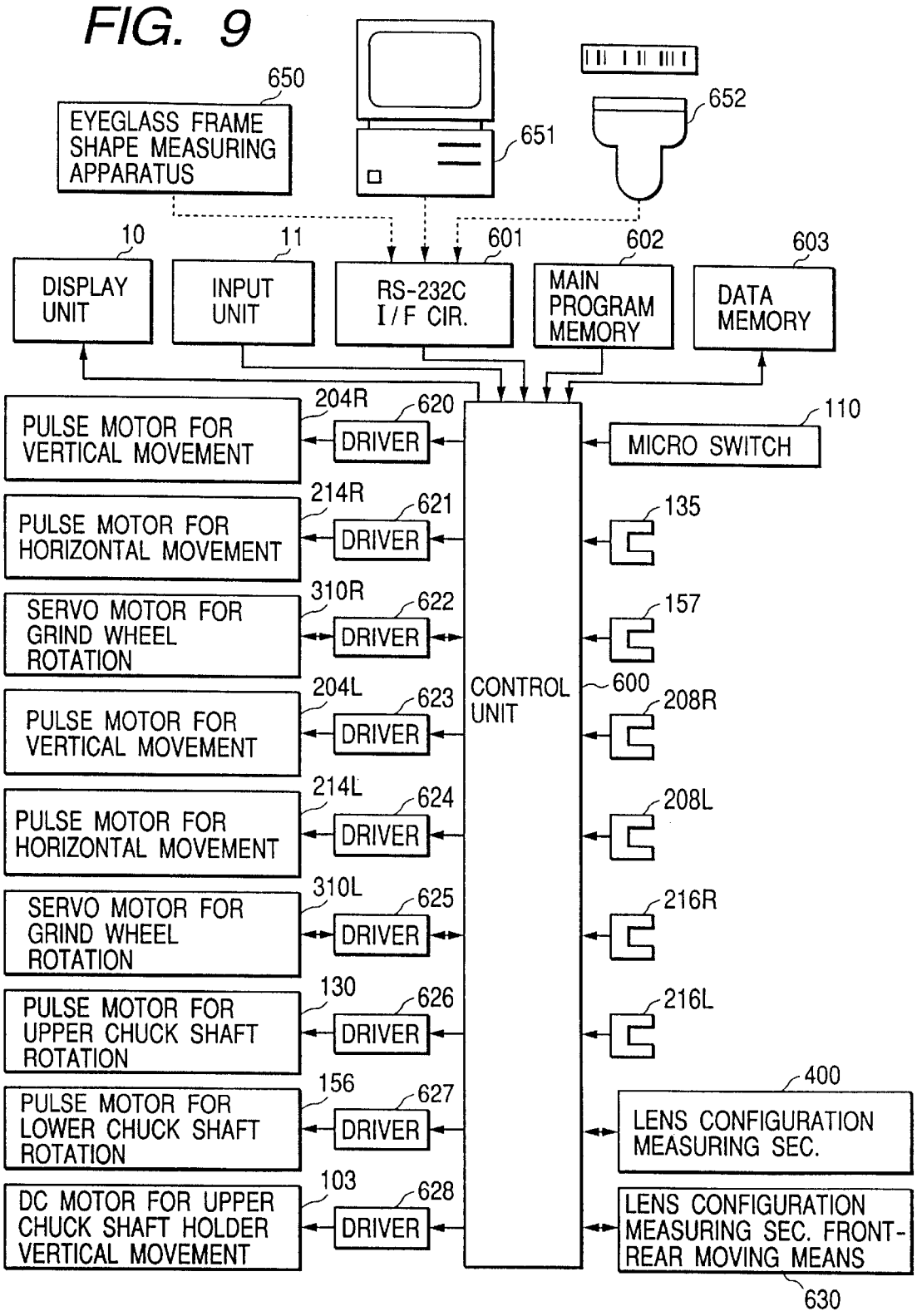
FIG. 9 is a schematic block diagram showing the control unit in the lens grinding apparatus of the invention.

FIG. 9 is a block diagram showing a general configuration of a control system of the lens grinding apparatus. Reference character 600 denotes a control unit which controls the whole apparatus. The display unit 10, input unit 11, micro switch 110, and photosensors are connected to the control unit 600. The motors for moving or rotating the respective parts are connected to the control unit 600 via drivers 620–628. The drivers 622 and 625, which are respectively connected to the servo motor 310R for the right lens grinding part 300R and the servo motor 310L for the left lens grinding part 300L, detect the torque of the servo motors 310R and 310L during the processing and feed back the detected torque to the control unit 600. The control unit 600 uses the torque information to control the movement of the lens grinding parts 300R and 300L as well as the rotation of the lens.

Reference numeral 601 denotes an interface circuit which serves to transmit and receive data. An eyeglass frame shape measuring apparatus 650, a host computer 651 for managing lens processing data, a bar code scanner 652, etc. may be connected to the interface circuit 601. A main program memory 602 stores a program for operating the lens grinding apparatus. A data memory 603 stores input data, lens thickness measurement data, and other data.

Operation

The operation of the lens grinding apparatus having the above-described configuration will be hereinafter described. First, description will made on operation for processing the ordinary lens of a large diameter.

The operator enters data on the shape of an eyeglasses frame (template) as determined with an eyeglass frame shape measuring apparatus (see, for example, U.S. Pat. No. 5,228,242). Display unit 10 provides a graphic representation of the lens shape (target lens shape) based on the eyeglasses frame data and this makes the apparatus ready for receiving the entry of processing conditions. Looking at the screen of the display unit 10, the operator manipulates input unit 11 to enter layout data such as PD value (and FPD value), the height of the optical center and the angle of astigmatic axis (cylindrical axis). The operator enters data on the constituent material of the lens, the selected mode to be performed (i.e., bevelling, planing, specular processing (polishing) or the like) and other necessary processing condition. At a processing center where orders from many optician's shops are processed in a centralized manner, the various necessary data are transmitted to the computer 651 through public communication lines, and the computer 651 enters the thus received data.

The operator makes further preparations for lens processing by attaching the fixing (securing) cup 160 to the front surface of the lens and fixing it by means of the adhesive pad 170. The fixing (securing) cup 160 is attached by a well-known method using a centering device such that the lens optical center and the astigmatic axis angle will satisfy specified relationships with the center of the cup 160 and the key groove 160*b*, and that the mark 160*d* will face the upper edge of the lens.

When the fixing (securing) cup 160 is properly attached, its base 160*a* is oriented to face down with respect to the grinding apparatus and fitted in the cup receptacle 159 with the key groove 160*b* engaging the key 159*b* to ensure that the mark 160*d* is in alignment with the mark 159*d* on the cup receptacle 159. As a result, the lens is positioned to satisfy a specified relationship with the chucking shaft 152. Prior to the start of grinding operation, the photosensor 157 detects the position of the light-shielding plate 158 to initialize the chucking shaft 152 so that it is set in a specified initial rotating position.

After mounting the lens on the cup receptacle 159, the operator touches the START switch on the input unit 11 to start the grinding apparatus. The apparatus first checks the minimal diameter to work on to see if it satisfies a specified condition based on the entered eyeglass frame data and layout data and, depending on the result, it selects a MODE setting for processing either a lens for "granny's glasses" or an ordinary lens. Alternatively, this can be accomplished by the operator who designates a proper setting by means of a MODE switch on the input unit 11. In the operation at the processing center, data as to whether the lens to be processed is one for "granny's glasses" may be fed into the apparatus together with the other necessary data or, alternatively, an automatic lens transporting apparatus may identify the type of the fixing (securing) cup to be adopted such that the lens grinding apparatus performs MODE setting based on the result of the identification.

If the selected processing mode is for an ordinary lens, the lens retainer 124 of a prolate shape is properly oriented in alignment with the astigmatic axis of the lens mounted on the cup receptacle 159. To this end, the lens retainer 124 is rotated about its axis such that it is properly oriented and, after this positioning step, the lens retainer 124 is lowered to the chucking position.

The orientation of the lens retainer 124 is described below more specifically. If the lens to be processed has no astigmatism, its rear surface usually has the same curvature in all directions, so the arcuate portions R1 of the lens retainer 124 can effectively retain the lens by making contact with substantially all part of the lens surface irrespective of the way in which the retainer 124 is oriented. If the lens has astigmatism, its rear surface is toric, so the lens retainer 124 will fail to contact the lens surface evenly depending on its position relative to the axis of astigmatism. Under the circumstances, if the lens to be processed has astigmatism, the lens retainer 124 is rotated about its axis such that its shortest axis (a minor diameter direction) is generally coincident with the astigmatic axis of the lens mounted on the cup receptacle 159 (in the specification of the invention, the direction of the astigmatic axis is taken on negative side), or in such a way that a direction normal to a direction of the long side of the lens retainer 124 (a direction normal to a major diameter direction) is generally coincident with the astigmatic axis of the lens, and after this positioning is complete, the lens is chucked. The rear surface of the chucked lens is mostly contacted by the arcuate portions R1 of the lens retainer 124 and the chucking pressure works in substantially the same way as in the case where the retainer is in the shape of a true circle to effectively hold the lens in position (because even if the lens retainer is in the form of a true circle, the chucking pressure applied to an astigmatic lens mainly works in a direction normal to the astigmatic axis and only a small portion of it works along the astigmatic axis). If the lens retainer 124 is oriented in this manner, the required force to hold the astigmatic lens is secured to reduce the possibility of misalignment of lens axis or a lens shift along the optical axis during processing.

A further advantage of orienting the lens retainer 124 in the manner described above is that the rear surface of the lens receives the chucking pressure in the same positions as the front surface is held by the fixing (securing) cup 160 and this effectively prevents lens breakage which would otherwise occur if the front surface of the lens is held in different positions than its rear surface.

If desired, the orientation of the lens retainer 124 that satisfies the specified relationship with the astigmatic axis of the lens being processed may be attained by positioning through rotation of the cup receptacle 159 about its axis. In this alternative case, the rotation of the lens being processed is controlled with reference to the thus determined rotational position.

After lens chucking is complete, the control unit 600 controls the movements of the front-rear moving means 630, lens configuration measuring section 400 and so forth to measure the configuration (edge position) of the lens based on the entered eyeglass frame configuration data and other necessary data. Thereafter, on the basis of the obtained information on the edge position of the lens, the control unit 600 provides lens bevelling data in accordance with a specified program. Subsequently, on the basis of the processing data, the unit 600 controls the rotation of the chucking shafts 121 and 152, the operation of the lens grinding sections 300R and 300L and the operation of the mechanism for moving them, such that rough grinding, fine (finishing) grinding and chamfering are performed in succession. In the respective processing stages, specified grinding wheels are set up in positions that correspond to the height of the lens to be processed. During processing, the chucking shafts 121 and 152 are rotated in synchronism. For details of the processing operations, reference should be made to European patent publication No. 798 076 A1.

Next, the processing of a lens for "granny's glasses" will be described. As in the case of processing ordinary lenses, the operator enters eyeglass frame data, layout data and other necessary data to make preparations for the processing of the lens of interest. The dedicated fixing (securing) cup 161 is attached to the lens to satisfy a specified positional relationship with the lens layout and subsequently fitted in the cup receptacle 159, with care being taken to ensure that the prolate cup receptacle 159 coincides with the fixing (securing) cup 161 which is also prolate in shape.

Based on the entered data, the operating mode of the grinding apparatus is set for processing the lens for "granny's glasses". In this operating mode, the lens retainer 124 is oriented in such a way that its prolate shape coincides with that of the cup receptacle 159 irrespective of the data on the astigmatic axis of the lens (with the rotation of the lens retainer 124 about its axis being initialized). With this orientation, the lens retainer 124, fixing (securing) cup 161 and cup receptacle 159 coincide with each other in their prolate shape, allowing the lens to be processed without interfering with the grinding wheel.

As described on the foregoing pages, the present invention offers the advantage that an ordinary lens having a large diameter to work on and a lens for "granny's glasses" can be efficiently processed without employing dedicated cup receptacle and lens retainers and yet the potential misalignment in the axis of the ordinary lens is sufficiently reduced.

What is claimed is:

1. A lens grinding apparatus for grinding an eyeglass lens to conform said lens to a shape of an eyeglass frame, said lens grinding apparatus comprising:

input means for inputting an angle of one of a cylindrical and an astigmatic axis;

a first lens rotating shaft having a cup receptacle member attached thereto, said cup receptacle member having a cross-section that is orthogonal to a rotational axis of the first lens rotating shaft and that is substantially prolate in outer shape, the cup receptacle member being adapted to receive either one of a first lens fixing cup for processing of a first lens which is substantially rectangular in shape and relatively smaller in size, and a second lens fixing cup for processing of a second lens of a different shape from said first lens and relatively larger in size, the first lens fixing cup having a first cup portion for holding and fixing the first lens, the first cup portion being substantially prolate in outer shape, and the second lens fixing cup having a second cup portion for holding and fixing the second lens, the second cup portion being substantially circular in outer shape;

a second lens rotating shaft having a lens retaining member attached thereto, said lens retaining member having a cross-section that is orthogonal to a rotational axis of the second lens rotating shaft, and that is substantially prolate in outer shape, the lens retaining member being used commonly with said first lens and said second lens;

rotating means for rotating said first and second rotating shafts independently of each other;

mode switching means for selectively setting a first lens processing mode and a second lens processing mode; and control means for controlling the rotating means based on a switching signal by the mode switching means, the control means controlling a relative rotational angle of the second lens rotating shaft to the first lens rotating shaft to hold either one of said first lens and said second lens therebetween, wherein in said first lens processing mode, a longitudinal direction of the prolate lens retaining member is made identical to a longitudinal direction of the cup receptacle member apart from any input of the angle of one of the cylindrical and the astigmatic axis; and wherein in said second lens processing mode, upon an input of the angle of the one of the cylindrical and the astigmatic axis, an orthogonal direction of the longitudinal direction of the prolate lens retaining member is made coincident with the inputted angle of the one of the cylindrical and the astigmatic axis.

2. The lens grinding apparatus according to claim 1, wherein said cup receptacle member has means for fitting one of said first lens fixing cup and said second lens fixing cup such that one of said cylindrical and said astigmatic axis of a respective one of first lens and second lens to be processed and fixed on one of said first lens fixing cup and said second lens fixing cup, is positioned to satisfy a specified relationship.

3. The lens grinding apparatus according to claim 1, wherein said lens retaining member is prolate in shape having two parallel edges and two arcs each having a center on the rotational axis of the second lens rotating shaft.

4. The lens grinding apparatus according to claim 1, wherein said lens receptacle member is prolate in shape having two parallel edges and two arcs each having a center on the rotational axis of the first lens rotating axis.

5. A lens grinding method for grinding an eyeglass lens to conform said lens to a shape of an eyeglass frame, said method comprising the steps of:

mounting one of a first lens fixing cup and a second lens fixing cup on a cup receptacle member, said first fixing cup for processing a first lens which is substantially rectangular in shape and relatively smaller in size, and said second lens fixing cup for processing a second lens of a different shape from said first lens and relatively larger in size, the first lens fixing cup being substantially prolate in outer shape and the second lens fixing cup being substantially circular in outer shape, the cup receptacle member being mounted on a first lens rotating shaft, said cup receptacle member having a cross-section that is orthogonal to a rotational axis of the first lens rotating shaft and that is substantially prolate in outer shape; and adjusting an angle of rotation of a second lens rotating shaft with respect to the first lens rotating shaft, said second lens rotating shaft having a lens retaining member attached thereto, said lens retaining member having a cross-section that is orthogonal to a rotational axis of the second lens rotating shaft, and that is substantially prolate in outer shape and being used commonly with said first lens and said second lens, and making a longitudinal direction of the prolate lens retaining member identical to a longitudinal direction of the prolate cup receptacle member apart from any input of an angle of one of a cylindrical and an astigmatic axis, in a first lens processing mode, and in a second lens processing mode, upon an input of the angle of one of the cylindrical and the astigmatic axis, making an orthogonal direction of the longitudinal direction of the prolate cup retaining member coincident with the inputted angle of the one of the cylindrical and the astigmatic axis; and relatively moving the second lens rotating shaft with respect to the first lens rotating shaft for chucking of one of said first lens and said second lens while maintaining a direction of each member.

6. A cup receptacle member adapted for use in a lens grinding apparatus, that is substantially prolate in outer shape, having a cross-section that is orthogonal to a rotational axis of a lens rotational axis of a lens rotating shaft to which the cup receptacle member is attached, the cup receptacle member having a means for fitting one of a first lens fixing cup and a second lens fixing cup, said first lens fixing cup for processing of a first lens which is substantially rectangular in shape and relatively smaller in size, and said second lens fixing cup for processing of a second lens of a different shape from said first lens and relatively larger in size, the first lens fixing cup being substantially prolate in outer shape and the second lens fixing cup being substantially circular in outer shape, said lens fixing cup fitting means fixing one of said first lens fixing cup and said second lens fixing cup such that one of a cylindrical and an astigmatic axis of a respective one of first lens and second lens to be processed fixed onto one of said first lens fixing cup and said second lens fixing cup is positioned to satisfy a specified relationship.

7. A lens chucking part adapted for use with an eyeglass lens grinding apparatus having first and second shafts rotatable about an axis, and relatively movable toward and away from each other for chucking a lens to be processed, said lens chucking part comprising:

a lens retainer mounted on an end of said first shaft, said lens retainer having a cross-section that is orthogonal to a rotational axis of the first shaft and that is an oblong shape in section as viewed in a plane perpendicular to said axis;

a cup holder mounted on an end of said second shaft facing said end of said first shaft, said cup holder having a cross-section that is orthogonal to a rotational axis of the second shaft and that is an oblong shape in section as viewed in a plane perpendicular to said axis;

wherein said cup holder is adapted to receive one of a first fixing cup and a second fixing cup, said first fixing cup for processing a first lens which is substantially rectangular in shape and relatively smaller in size, and a second fixing cup for processing a second lens of a different shape from said first lens and relatively larger in size, the first fixing cup being substantially prolate in outer shape and the second fixing cup being substantially circular in outer shape.

8. A lens chuck part according to claim 7, wherein said first fixing cup has a cylindrical base received by said cup holder and a substantially conical cup portion to be mounted on the lens, and wherein an outermost perimeter of said cup portion about said axis is oblong.

9. A lens chuck part according to claim 7, wherein said oblong shape of said lens retainer is coincident with said oblong shape of said cup holder.

10. A lens chuck part according to claim 7, wherein each of said oblong shapes of said lens retainer and cup holder has linear portions parallel to each other, and arcuate portions each connecting said linear portions.

11. A lens chuck part according to claim 10, wherein each of said oblong shapes of said lens retainer and cup holder has a minor diameter no more than 19 mm.

12. A lens chuck part according to claim 7, further comprising:

means for relatively rotating said first shaft with respect to said second shaft prior to chucking of the lens to establish an angular position wherein a minor diameter of said oblong shape of said lens retainer is coincident with a direction of one of a cylindrical and an astigmatic axis of the lens, and relatively moving said first shaft with respect to said second shaft for chucking of the lens while maintaining said angular position, when processing the second lens upon an input of the direction of the one of the cylindrical and the astigmatic lens.

13. A lens chuck part according to claim 7, wherein each said first fixing cup and said second fixing cup is made of rigid material.

14. A lens check part according to claim 7, further comprising:

means for relatively rotating said first shaft with respect to said second shaft prior to chucking of the lens to establish an angular position wherein a major diameter of said oblong shape of said lens retainer is identical to a major diameter of said oblong shape of said cup holder, and relatively moving said first shaft with respect to said second shaft for chucking of the lens while maintaining said angular position when processing the first lens.

15. A lens chuck part according to claim 8, wherein said oblong outermost perimeter of said first fixing cup is coincident with each of said oblong shapes of said lens retainer and said cup holder.

16. A lens chuck part according to claim 8, wherein each of said oblong shapes of said lens retainer, cup holder and fixing cup has linear portions parallel to each other, and arcuate portions each connecting said linear portions.

17. A lens chuck part according to claim 8, wherein each of said oblong shapes of said lens retainer, cup holder and fixing cup has a minor diameter no more than 19 mm.

18. A lens chuck part according to claim 13, wherein said rigid material includes a mixture of polycarbonate and glass fibers.

* * * * *